United States Patent [19]

Woolslayer et al.

[11] Patent Number: 4,725,179

[45] Date of Patent: Feb. 16, 1988

[54] AUTOMATED PIPE RACKING APPARATUS

[75] Inventors: Joseph R. Woolslayer; Cecil Jenkins, both of Tulsa; John C. Brittain, Sperry, all of Okla.

[73] Assignee: Lee C. Moore Corporation, Tulsa, Okla.

[21] Appl. No.: 926,217

[22] Filed: Nov. 3, 1986

[51] Int. Cl.[4] ..... E21B 19/14

[52] U.S. Cl. ..... 414/22; 175/52; 211/70.4

[58] Field of Search ..... 414/22, 745; 175/52, 175/85; 211/70.4

[56] References Cited

U.S. PATENT DOCUMENTS

| | | | |
|---|---|---|---|
| 2,416,815 | 3/1947 | Calhoun | 414/22 |
| 2,730,246 | 1/1956 | Stone | 414/22 |
| 2,773,605 | 12/1956 | De Jarnett | 414/22 |
| 3,501,017 | 3/1970 | Johnson et al. | 175/85 X |
| 3,561,811 | 2/1971 | Turner, Jr. | 414/22 X |
| 3,633,767 | 1/1972 | Mitchell | 414/22 |
| 3,664,439 | 5/1972 | Council | 175/85 |
| 3,800,962 | 4/1974 | Ham | 414/22 |
| 3,895,677 | 7/1975 | Bokenkamp | 175/52 X |
| 4,042,123 | 8/1977 | Sheldon et al. | 414/22 |
| 4,117,941 | 10/1978 | McCleskey, Jr. et al. | 414/22 |
| 4,269,554 | 5/1981 | Jackson | 414/22 |
| 4,274,778 | 5/1981 | Putnam et al. | 414/22 |
| 4,345,864 | 8/1982 | Smith, Jr. et al. | 414/22 |
| 4,531,875 | 7/1985 | Krueger | 414/22 |
| 4,604,724 | 8/1986 | Shaginian et al. | 414/22 X |
| 4,610,315 | 9/1986 | Koga et al. | 414/22 X |
| 4,621,974 | 11/1986 | Krueger | 414/22 X |

*Primary Examiner*—Leslie J. Paperner

*Attorney, Agent, or Firm*—Alan T. McCollom

[57] ABSTRACT

Apparatus for use to facilitate threading and unthreading substantially vertical lengths of pipe on a drilling rig by moving the pipe between the well bore center line and a racking assembly. An arm having a gripping head mounted thereon is extendable and retractable relative to a carriage mounted on the drilling rig working board. When storing pipe, the lower end of each pipe is set on a support assembly which includes a plurality of switches which signal the position of each pipe thereon. The arm and carriage are moved under control of a computer to an appropriate slot for storing the upper end of the pipe stand. When running pipe into the well bore, the arm and carriage move the upper end of the pipe to the center line of the well and when the traveling block of the drilling rig picks up the pipe, a signal generated by the switch beneath the pipe causes the carriage and arm to move to the location for unracking the next stand of pipe.

26 Claims, 13 Drawing Figures

AUTOMATED PIPE RACKING APPARATUS

BACKGROUND AND SUMMARY OF THE INVENTION

The instant invention relates to automated pipe racking apparatus and more particularly to such apparatus for use to facilitate coupling and uncoupling substantially vertical lengths of pipe.

In the drilling of oil and gas wells, a string of drill pipe having a drill bit mounted on the lower end thereof is suspended from a traveling block in a drilling rig mast. The drill string is suspended from the traveling block by a swivel which enables rotational force to be applied to the drill string, typically by a rotary table at the drilling rig floor, to advance the depth of the drilled bore. As the depth of the bore increases, additional lengths of drill pipe are added to the drill string at the surface.

Periodically it is necessary to pull the drill string from the bore in order to change the drill bit or to run testing or other equipment into the bore on the end of the drill string.

When pulling drill pipe from the bore, the traveling block is raised until a stand of pipe extends above the drilling rig floor. In the usual case a stand comprises three pieces of pipe totaling approximately 90 feet in length. Next, slips are placed between the pipe and the drilling rig floor in order to suspend the drill string in the well bore from a point beneath the pipe stand which extends above the drilling rig floor. Thereafter, the connection between the pipe stand and the remainder of the drill string is unthreaded and the lower end of the stand is placed on a support pad, sometimes referred to as a setback, on the drilling rig floor. Next, a man positioned in the upper portion of the rig disconnects the upper end of the stand from the traveling block and places the upper end of the stand between a set of racking fingers which support the stand in a substantially vertical position. The traveling block is then lowered to pick up the drill string and the process is repeated until all of the pipe, in three piece stands, is supported at the lower ends thereof on the setback with the upper ends being constrained between pairs of racking fingers.

When running a new drill bit or a tool into the well bore the above-described process is reversed. That is, a man on a platform adjacent the racking fingers removes a stand of pipe and connects it to the traveling block. When the traveling block is lifted, the lower end swings into position above the well bore, the tool or bit is mounted on the lower end thereof, and the traveling block lowers the stand into the bore. Next, slips are inserted between the stand and the drilling rig floor to suspend the stand in the well bore while the traveling block is raised to permit the upper end of another stand to be connected thereto. This process is repeated until the drill string reaches the desired depth in the well bore.

The above described procedure for running a drill string into or out of a well bore poses a danger to the person working on the platform above the drilling rig floor. This job entails reaching from the platform to the center line of the well in order to connect the upper end of a pipe stand to the traveling block (and to disconnect the same therefrom) and moreover requires moving the upper end of each pipe stand between the racking fingers and the center line of the well. This is one of the most dangerous jobs on the drilling rig.

There have been a number of prior art efforts to automate one aspect or another of the procedure for running drill pipe into and out of the well bore. Some of these procedures incorporate the use of mechanical arms mounted on the drilling rig mast adjacent the racking fingers for moving the upper ends of the pipe stands between the well center line and the racking fingers. Some include lower arms or dollies for simultaneously gripping the lower end of the stand in order to move the same between the well center line and the setback. Some of the prior art devices move the stands in response to control signals generated by a computer.

All of the prior art devices suffer from several disadvantages. First, many of the prior art devices are cumbersome in their design and thus in their operation and are expensive to build. None of the prior art devices incorporates a computer controlled apparatus for moving the upper stand of pipe while permitting the lower stand to be swung in the usual fashion between the setback and the well center line. That is, prior art computer controlled devices typically include a lower gripping arm or dolly for moving the lower end of each pipe stand between the well center line and the set back. Such a design has been necessary in the past in order to coordinate movement of the upper and lower ends of the stand but such design increases the cost and complexity of the equipment.

The prior art apparatus typically includes only a single arm for manipulating pipe at the upper end of a pipe stand. Since the usual pipe storage facility includes two sets of opposed racking fingers, 180° movement of the arm is required in order to access both sets of racking fingers. The speed of operation and the system design would be simplified if 180° movements were not required.

The instant invention comprises apparatus for use to facilitate coupling and uncoupling substantially vertical lengths of pipe by moving the pipe between a coupled position thereof and a racking assembly. An arm assembly includes a gripping head mounted thereon for grasping a pipe. Means are provided for moving the arm assembly. The lower end of a pipe received in the racking assembly is supported by a support assembly which includes means for sensing the location of the lower end of each pipe on the support assembly. Control means connected to the sensing means and to the moving means is provided for moving the arm assembly to a preselected position dependent upon the position of the lower end of a pipe which is set on or removed from the support assembly. In one aspect of the invention, the arm assembly includes a first arm and a second arm which are extendable and retractable along axes oriented at 90° to one another.

The instant invention provides automated pipe racking apparatus which overcomes the disadvantages of the prior art and which provides additional advantages that will be apparent to a person having ordinary skill in the art when the following detailed description is considered in view of the accompanying drawings, wherein:

FIG. 10 is also a view taken along line 10—10 in FIG. 12.

DETAILED DESCRIPTION OF THE PREFERRED EMBODIMENT OF THE INVENTION

Indicated generally at 10 is a portion of a drilling rig. Mounted on the drilling rig is a portion of an automated pipe racking apparatus, indicated generally at 12, constructed in accordance with the instant invention.

Figure 4:
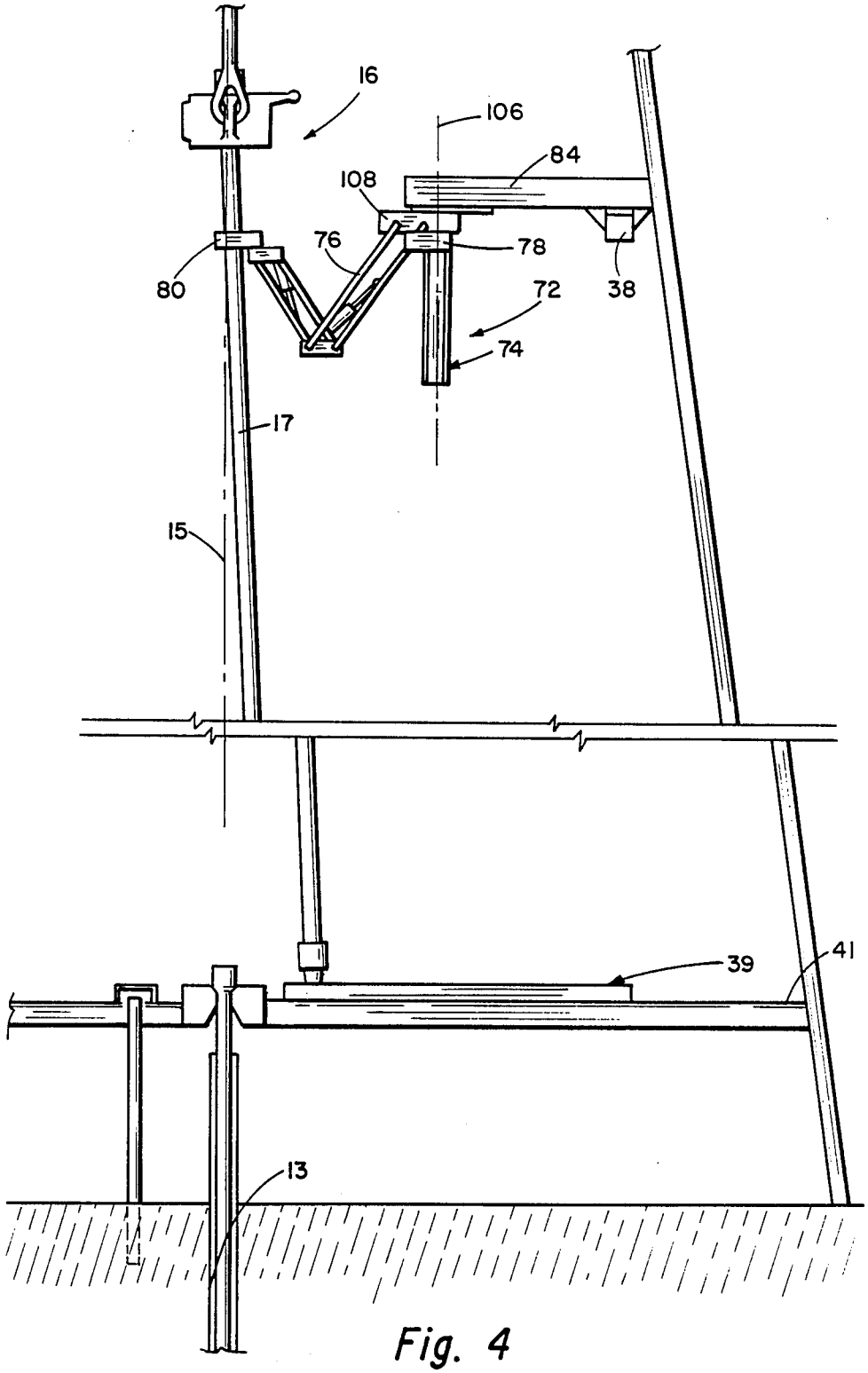
FIG. 4 is a view taken along line 4—4 in FIG. 2 showing an arm gripping a stand of pipe.

Drilling rig 10 includes a mast 14 which has a traveling block (not visible) suspended at the upper end thereof. The traveling block is suspended over the center line of a well bore 13 (in FIG. 4) and includes a set of elevators 16 (visible in FIGS. 2 and 4) suspended therefrom for grasping a drill pipe 17. The well bore center line is designated by a dot-dash line 15 in FIGS. 4 and 5 and by the intersection of dot-dash lines, such also being designated by the numeral 15, in FIGS. 2 and 7. The elevators include a ram 19 (in FIG. 2) for opening and closing the elevators responsive to ram extension and contraction. Once a drill pipe is grasped by elevators 16, as shown in FIG. 4, the traveling block may be raised or lowered as necessary to lower drill pipe into or remove drill pipe from the well bore.

Figure 1:
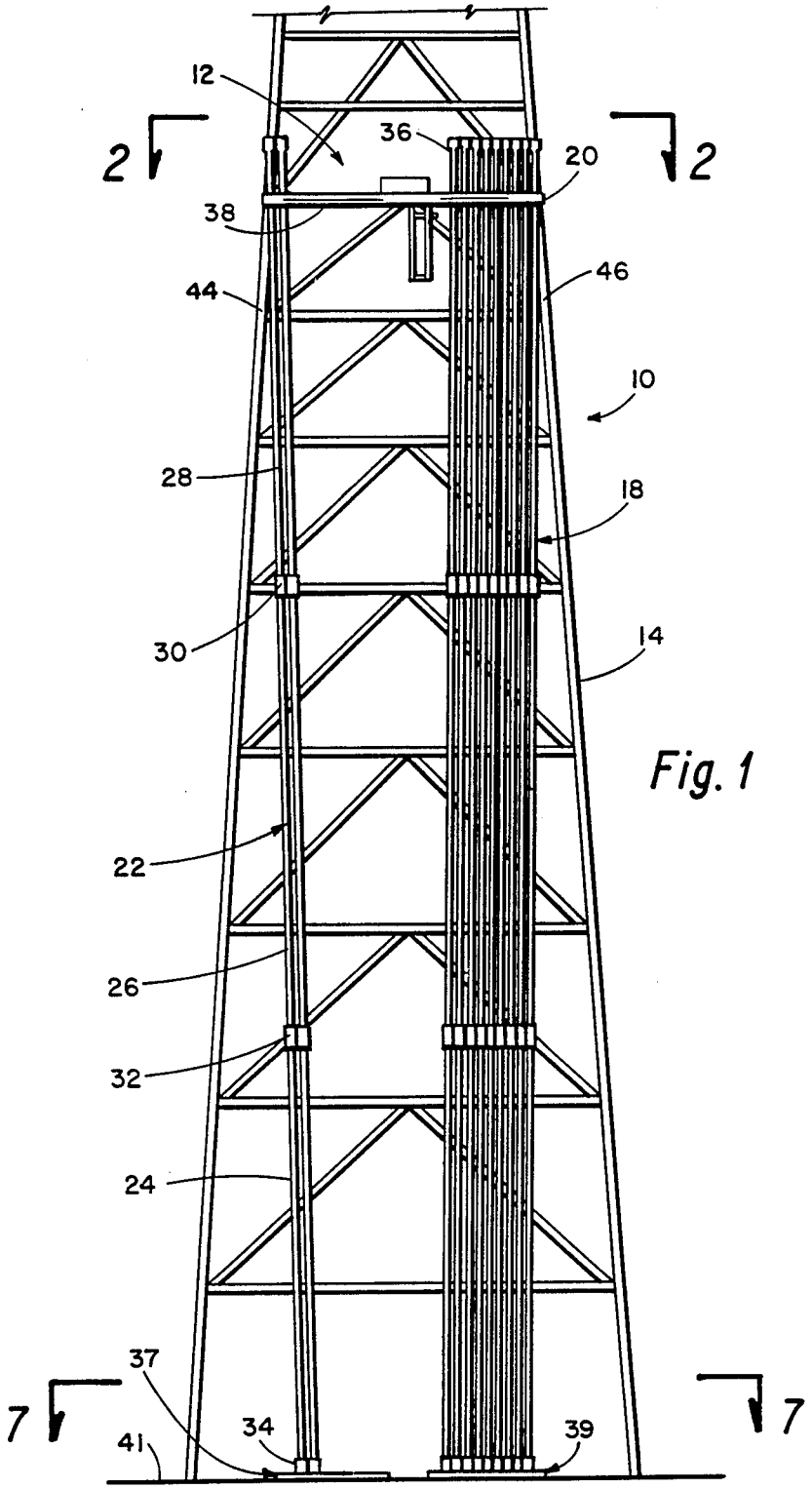
FIG. 1 is a side elevational view of a portion of a drilling rig having the automated pipe racking system of the invention incorporated therein.
Figure 2:
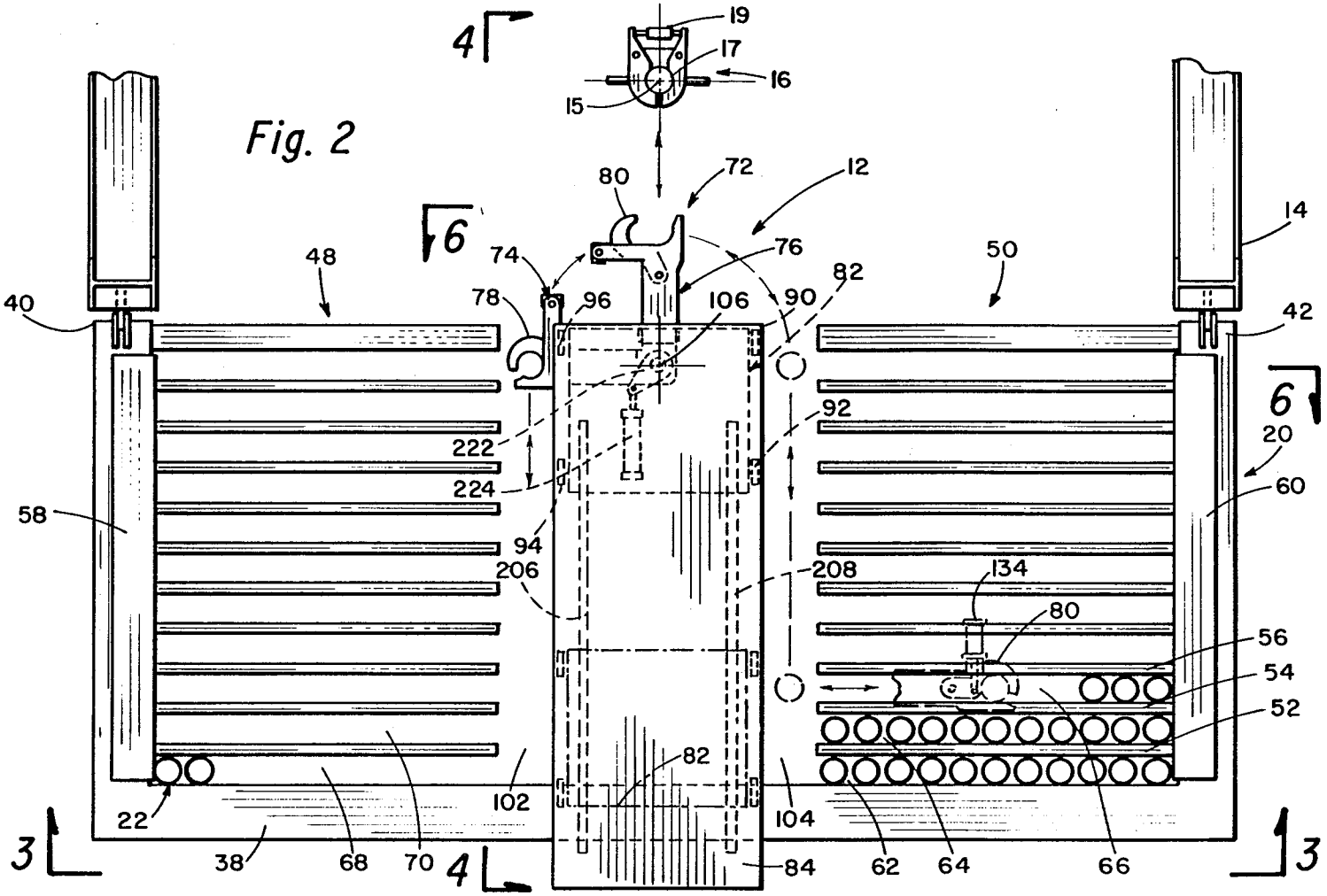
FIG. 2 is a partial view taken along line 2—2 in FIG. 1.

In FIGS. 1 and 2 a plurality of drill pipe stands, indicated generally at 18, have the upper ends thereof received in a rack 20, such being mounted on mast 14. Each of the pipe stands, like pipe stand 22, is composed of three substantially identical pipes, like pipes 24, 26, 28 in pipe stand 22. The pipes are threaded together at joints 30, 32. Each of the pipes on the lower end of each stand, like pipe 24, includes a male-threaded coupling 34 which may be threadably engaged with a female-threaded coupling, like coupling 36, at the top of another stand of pipe. In this manner a continuous string of drill pipe may be made up and lowered into well bore 13. The lower ends of the pipe stands are set on one of two support assemblies 37, 39 which are in turn supported by a floor 41 on the drilling rig.

Figure 3:
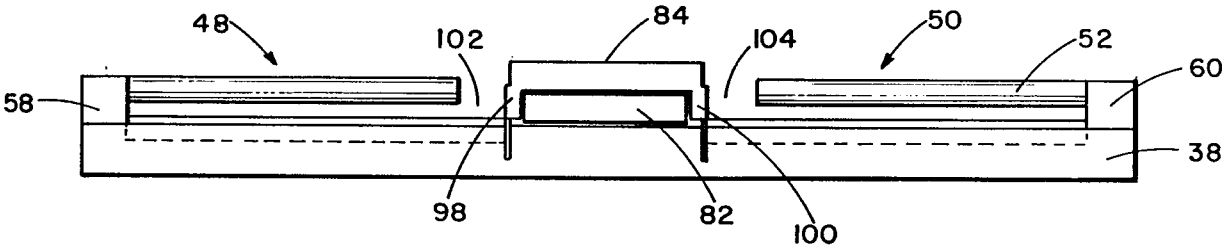
FIG. 3 is a view taken along line 3—3 in FIG. 2.

Directing attention now to FIGS. 2, 3, and 5, consideration will be given to the structure of racking assembly 20. The racking assembly includes a U-shaped frame 38 which is mounted on mast 14 via pinned connections 40, 42 and is further supported by upright mast elements 44, 46 (in FIG. 1). The racking assembly includes a first set of fingers indicated generally at 48 and a second set of fingers indicated generally at 50. The fingers comprise a plurality of rods, like rods 52, 54, 56, each of which has one end thereof mounted on an associated rod support member 58, 60 and which extends substantially orthogonally therefrom. Rod support members 58, 60 are fixedly mounted on frame 38. Finger 52 and frame 38 define therebetween a pipe storage position or slot 62 into which are received the upper ends of pipe stands 18. Additional slots, like slots 64, 66, are formed between adjacent fingers, like fingers 52, 54, and fingers 54, 56, respectively. Similar slots, like slots 68, 70, are formed by finger set 48 opposite the slots formed by finger set 50.

Indicated generally at 72 is an arm assembly, such including a first arm 74 and a second arm 76. Arms 74, 76 include pipe gfipping heads 78, 80, respectively. Pipe received in gripping head 80 is shown in dashed lines in several positions in FIG. 2 to indicate the travel path thereof when moving pipe between center line 15 of the well and a pipe storage position. Each of arms 74, 76 is fixed at 90° relative to the other arm and the entire arm assembly is suspended from a carriage 82. The carriage in turn is rollingly mounted on the underside of a working board 84 which is mounted on frame 38 and which extends between finger sets 48, 50. Flanges 86, 88 (in FIG. 5) are welded to the underside of board 84 and to frame 38 to fix the working board to the frame. Rollers 90, 92, 94, 96 are mounted on carriage 82 and carry the same in a pair of opposed tracks 98, 100, the ends of which are viewable in FIGS. 3 and 6. Track 98 is viewable in dashed lines in FIG. 5. Carriage 82 is slidable between a first position shown in dashed lines in FIGS. 2 and 5 and a second position shown in dot-dash lines. A first alley 102 is formed between finger set 48 and working board 84 and a second alley 104 is formed between finger set 50 in the working board. As will later be described in more detail, arms 74, 76 extend to grasp pipe stands and transfer them along alley 102 or alley 104 between elevators 16 and various preselected pipe storage positions in the slots, like slots 62, 64, 66, 68, 70.

Figure 5:
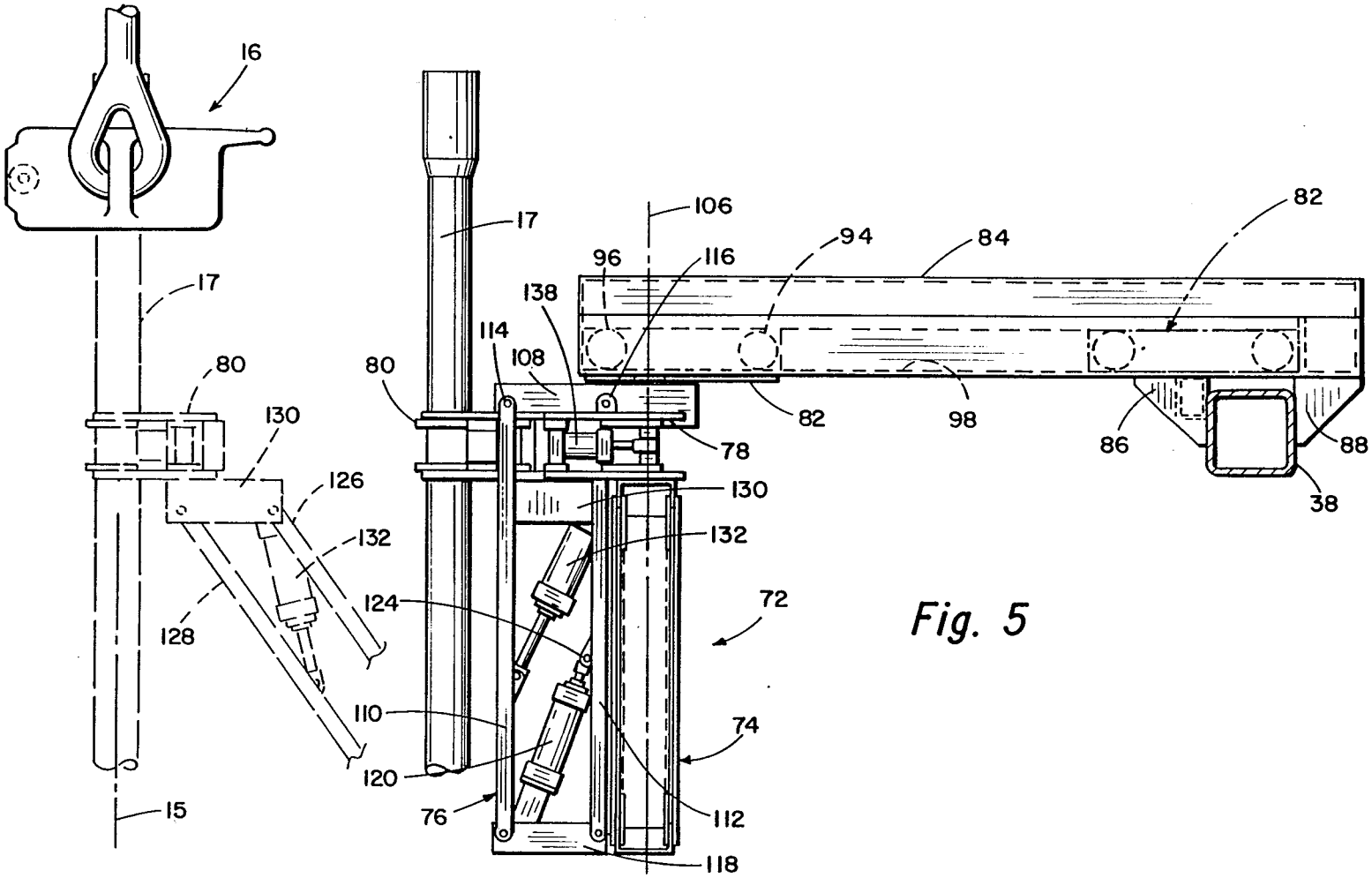
FIG. 5 is an enlarged view of a portion of FIG. 4 with the arm shown contracted in solid lines and extended in dashed lines.
Figure 6:
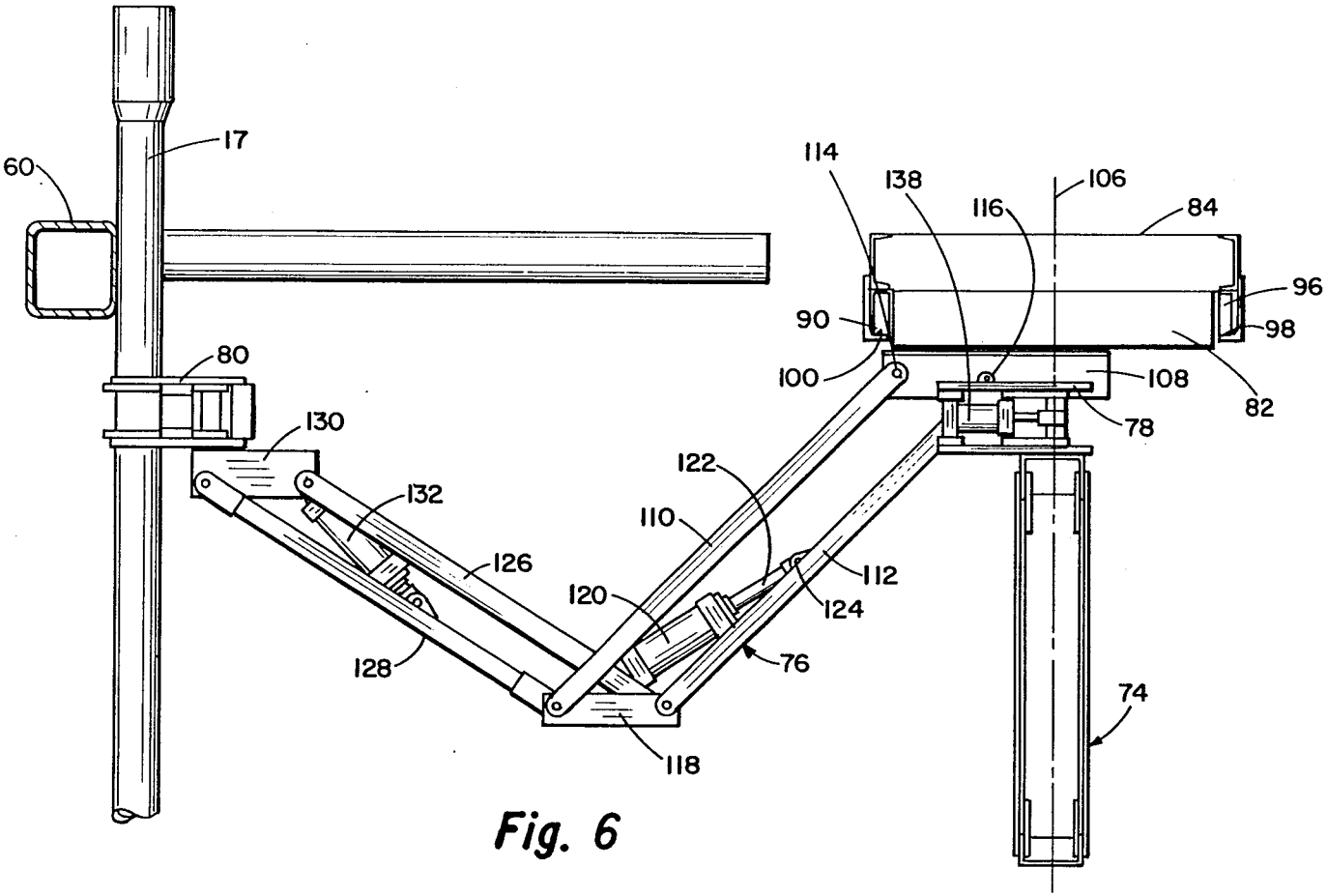
FIG. 6 is a view taken along line 6—6 in FIG. 2 with the arm shown gripping a pipe in the racking assembly.

Attention is directed to FIGS. 4–6 wherein the structure of arm assembly 72 will be further described. The arm assembly is suspended from carriage 82 by a vertical pivot shaft (not visible in FIG. 5) having an axis of rotation designated by dot-dash line 106. An arm support member 108, such also being referred to herein as rotating means, is mounted on the lower end of the pivot shaft.

Arm 76 includes a first set of parallel links 110, 112 each of which is pivotally mounted on arm support member 108 via pivotal connections 114, 116, respectively. The other end of links 110, 112 are pivotally connected to an elbow member 118. Two additional links (not visible) are located behind links 110, 112 in the view of FIGS. 4–6 and are also pivotally connected to arm support 108 and elbow member 118 about the same axes of rotation as links 110, 112. A hydraulic ram 120 includes therein a rod 122 which is pivotally connected via connector 124 to a bar (not visible) which extends between link 112 and the link behind link 112. The other end of ram 120 is pivotally connected to member 118. It can thus be seen that extension of ram 120 shifts links 110, 112 between the solid-line configuration shown in FIG. 5 and that shown in FIG. 6. When links 110, 112 are in the configuration of FIG. 6, retraction of ram 120 returns the links to the configuration of FIG. 5.

Links 126, 128 each have one end pivotally connected to member 118 with link 128 being connected about the same axis of rotation as link 110 and link 126 being connected about the same axis of rotation as link 112. The other ends of links 126, 128 are pivotally connected as shown to a gripping head support element 130. A second set of links (not visible) are located behind each of links 126, 128 and are pivotally connected to member 118 and element 130 about the same axes of rotation as lengths 126, 128.

A second hydraulic ram 132 has one end pivotally connected to element 130 and the other end pivotally connected to a bar (not visible) that extends between link 128 and the link directly therebehind. Thus, extension and retraction of ram 132 shifts links 126, 128 between an extended position (shown in dashed lines in FIG. 5) and a retracted position (shown in solid lines in FIG. 5) in which the links are aligned behind links 110, 112.

Pipe gripping head 80 includes a hydraulic ram 134, best viewed in the dashed-line configuration of pipe gripping head 80 in FIG. 2, which enables pipe gripping head 80 to shift between an open position (shown in solid lines in FIG. 2) and a closed position (shown in dashed lines in FIG. 2). Pipe gripping head 8 is substantially identical to head 80 and is shown in FIG. 2 in the closed position. Pipe gripping head 78 includes therein a ram 138 (in FIG. 5) for opening and closing the gripping head in the same fashion as ram 134 opens and closes gripping head 80. Arms 74, 76 are substantially identical to one another and are each mounted on arm support member 108 at right angles to one another.

Figure 7:
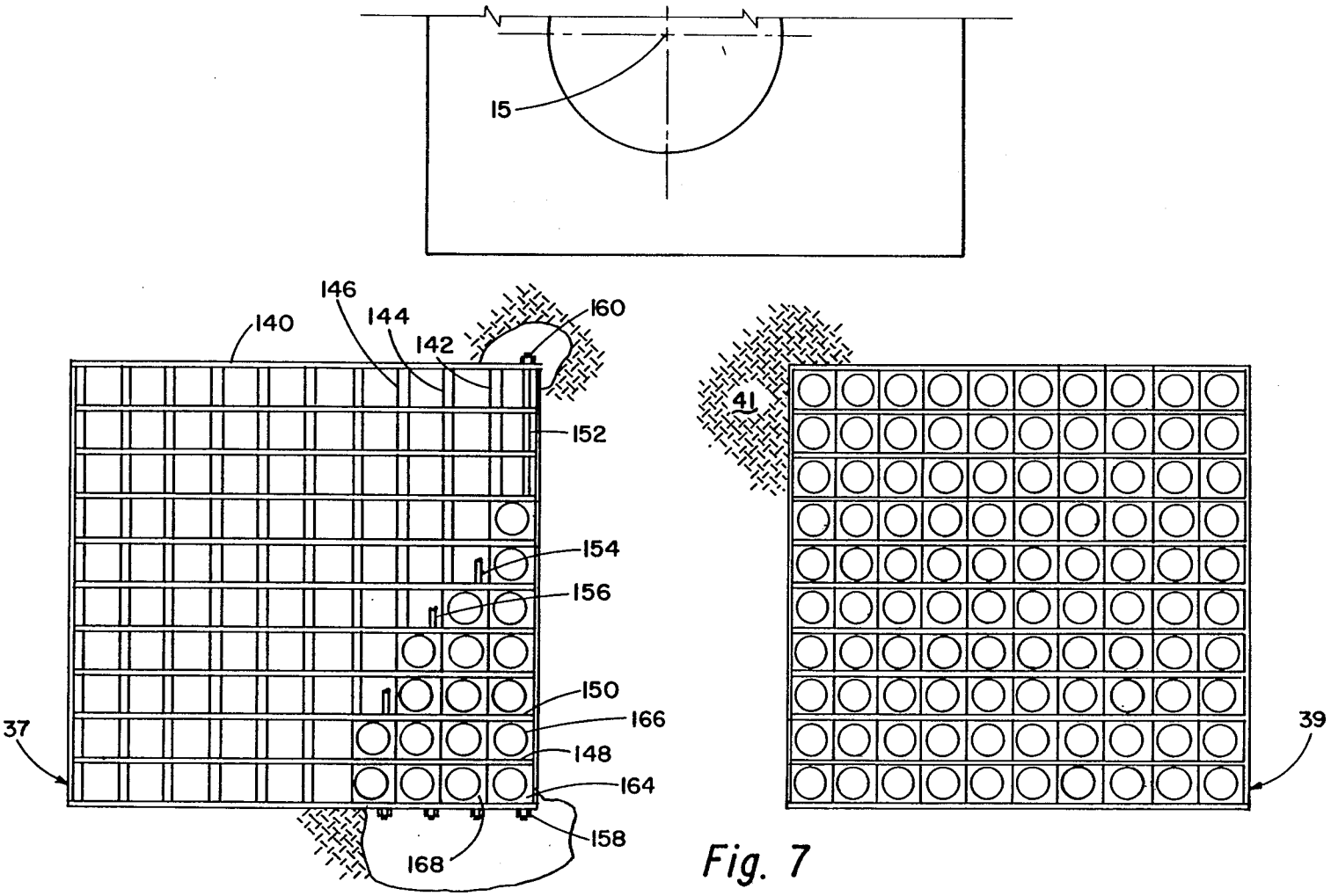
FIG. 7 is an enlarged view taken along line 7—7 in FIG. 1.
Figure 8:
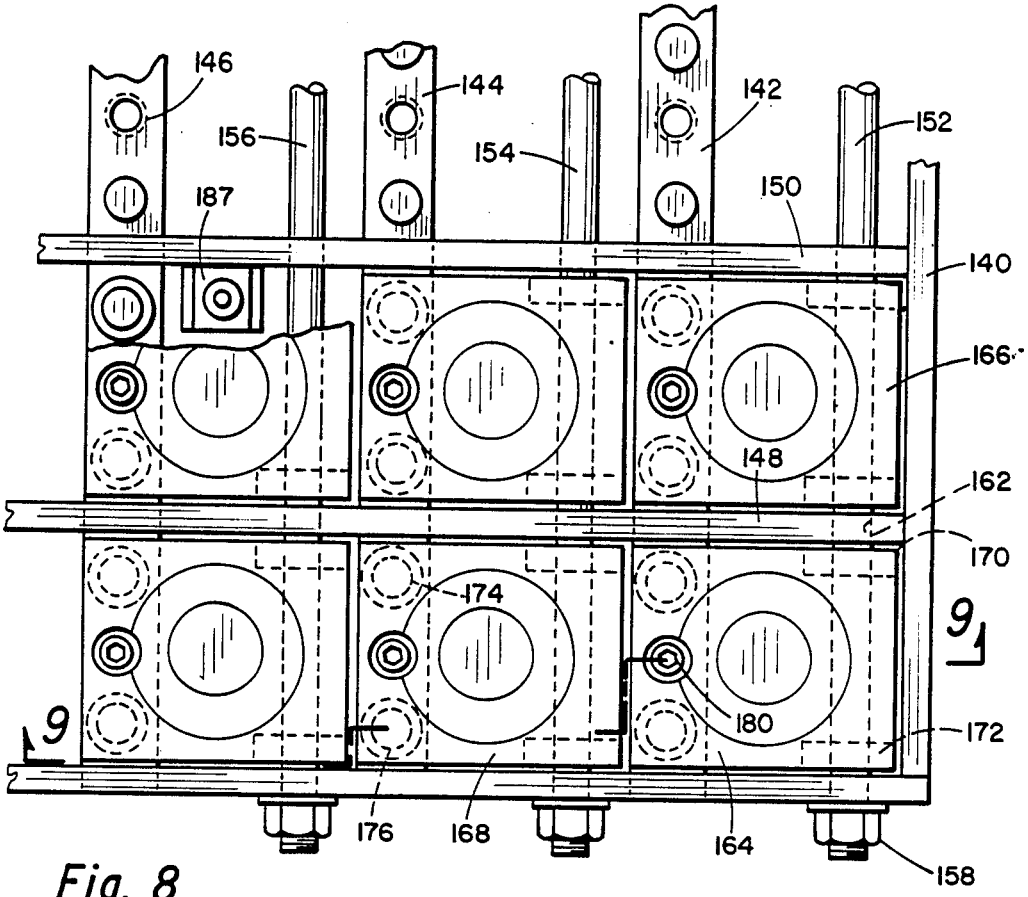
FIG. 8 is an enlarged view of a portion of FIG. 7.
Figure 9:
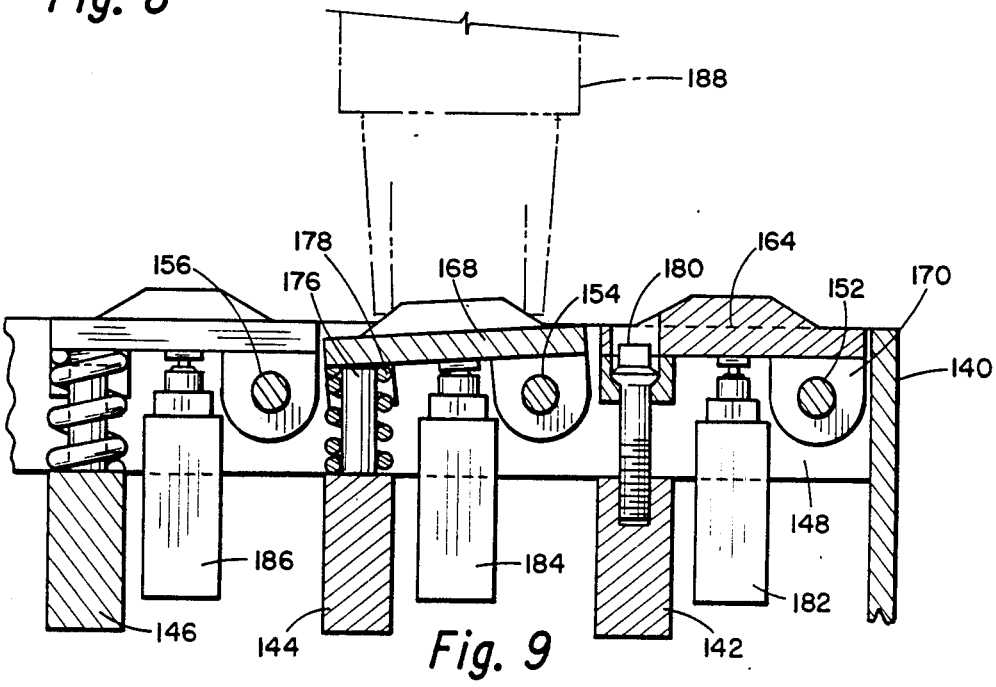
FIG. 9 is a view taken along line 9—9 in FIG. 8.

Turning now to FIGS. 7–9, consideration will be given in more detail to the structure of support assemblies 37, 39. Assembly 37 comprises a substantially square frame 140 having a plurality of elongate supports, like supports 142, 144, 146, extending from one side of the frame to the opposing side. A plurality of cross members, like members 148, 150 are mounted on the supports and extend between opposing sides of frame 140 at right angles to the supports. A plurality of hinge pins, like hinge pins 152, 154, 156, extend across frame 140 parallel to the supports and are bolted to the frame at either end thereof, like pin 152 is bolted via nuts 158, 160. The hinge pins pass through bores, like bore 162 (in FIG. 8) in cross member 148, formed in each of the cross members.

A plurality of pipe support elements, like elements 164, 166, 168 are hingingly mounted on the hinge pin. For example, pipe support element 164 includes a pair of depending ears 170, 172, having bores formed therethrough through which hinge pin 152 is received. Each of the other pipe support elements is hingingly mounted to its associated hinge pin in the same fashion. A plurality of posts, like posts 174, 176 mounted on support 144, are mounted on the supports. Each post includes a spring, like spring 178 around post 176, thereabout. For each pipe support element there are two posts and associated springs which tend to urge the pipe support element upwardly while the posts define a lower position below which the pipe support element cannot move. For each pipe support element there is a bolt threadably received through the pipe support element into the support therebeneath, like bolt 180 is received in support 142. The bolt limits the upper range of motion of the pipe support element and maintains the springs around the posts adjacent bolt 180 in a compressed condition.

Below each pipe support element is a switch, like switches 182, 184, 186, 187 such also being referred to herein as sensing means. Each switch is mounted on a cross member, like switches 182, 184, 186 are mounted on cross member 148 and switch 187 is mounted on cross member 150, and is in an unactuated condition when in the configuration of switches 182, 186. When a sufficient downward force is exerted on the pipe support element over a switch, the pipe support element moves downwardly until it is supported by the posts beneath the pipe support element thereby actuating the switch, like switch 184 is actuated as a result of force exerted by the lower end of a pipe 188 which is set on pipe support element 168.

Figure 11:
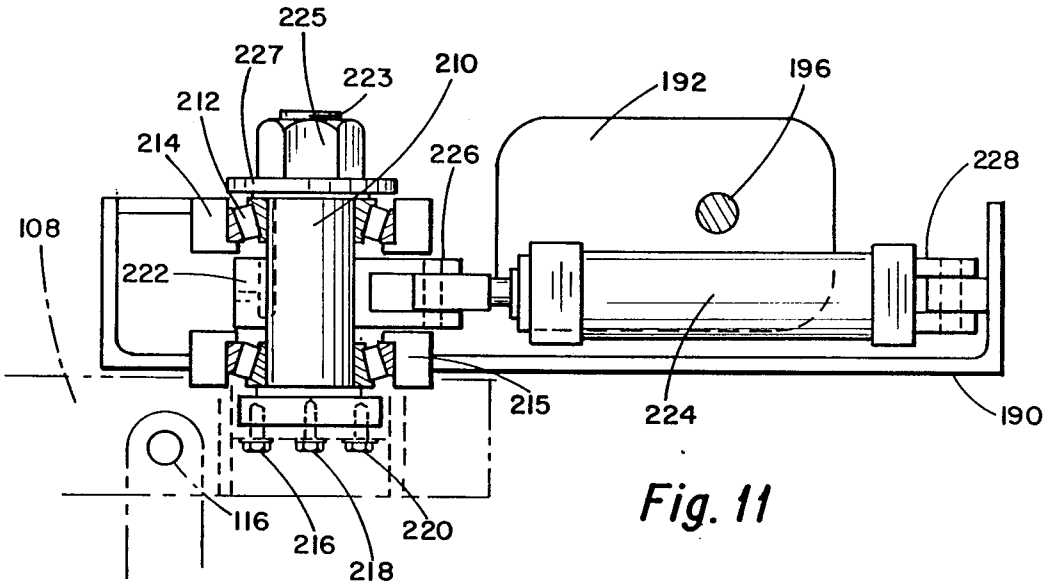
FIG. 11 is a view taken along line 11—11 in FIG. 12.
Figure 12:
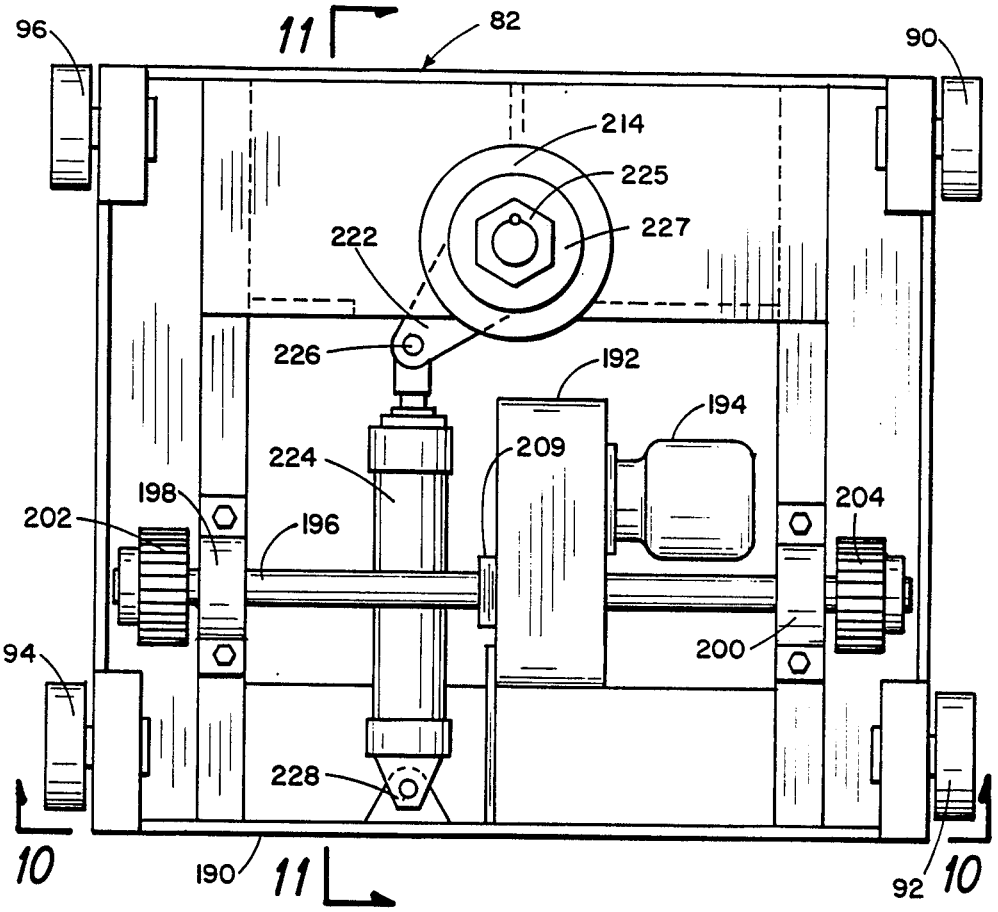
FIG. 12 is a view taken along line 12—12 in FIG. 10.
Figure 10:
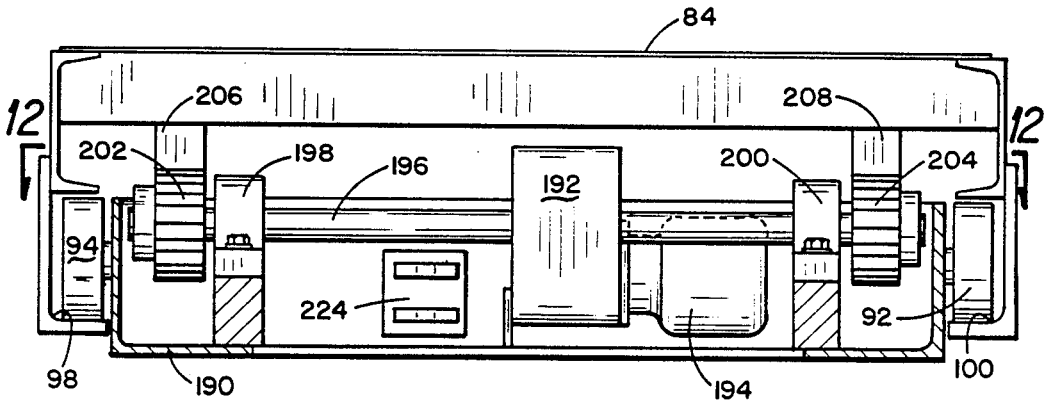
FIG. 10 is an enlarged view of a portion of FIG. 3 with some of the structure being shown in cross section.

Attention is directed to FIGS. 10, 11, and 12 wherein is shown a more detailed view of the structure of carriage 82. Parts which have been previously identified are identified in FIGS. 10–12 with the same number as in preceeding drawings. Carriage 82 includes a frame 190 having a speed reducer 192 mounted thereon. The speed reducer is driven by a hydraulic motor 194 which is mounted on the speed reducer. A drive shaft 196 extends from the speed reducer and is received through a pair of pillow blocks 198, 200 which are mounted on the frame.

Drive shaft 196 has mounted on the outer ends thereof a pair of drive pinions 202, 204. Each of the pinions engage in rack-and-pinion fashion with an associated gear rack 206, 208 (also viewable in dashed lines in FIG. 2) which is mounted on the underside of working board 84. When drive shaft 196 is rotated under the power of hydraulic motor 194, rotation of pinions 202,204 relative to gear racks 206, 208 causes carriage 82 to be rolled, on wheels 90, 92, 94, 96, along tracks 98, 100. Reversing the direction of rotation of the hydraulic motor reverses the direction of carriage movement. A conventional tachometer 209 is mounted on shaft 196 for generating a signal carrying information relating to the direction and number of rotations of shaft 196. The purpose for generating such a signal will be hereinafter more fully explained.

An arm support pivot shaft 210 is mounted on Frame 190 via bearings, one of which is bearing 212, and bearing supports 214, 215. The lower end of shaft 210 is bolted, via bolts 216, 218, 220 to arm support member 108. A pivot lever 222 (also viewable in dashed lines in FIG. 2) is keyed to shaft 210. The upper end of shaft 210 includes a threaded outer portion 223 over which a nut 225 is threadably engaged. The nut is tightened against a thrust washer 227 to enable bearing-constrained rotational movement of shaft 210. One end of a hydraulic ram 224 (also viewable in dashed lines in FIG. 2) is connected via pivotal connection 226 to pivot lever 222. The other end of the ram is pinned to frame 190 via connection 228.

It can thus be seen that when ram 224 is extended, force is exerted against pivot lever 222 thereby rotating shaft 210. The ram is constructed so that when fully extended, shaft 210 rotates substantially 90° clockwise from the position shown in FIG. 12. When the ram is returned to its contracted position, the shaft rotates 90° counter-clockwise to the position of FIG. 12.

Figure 13:
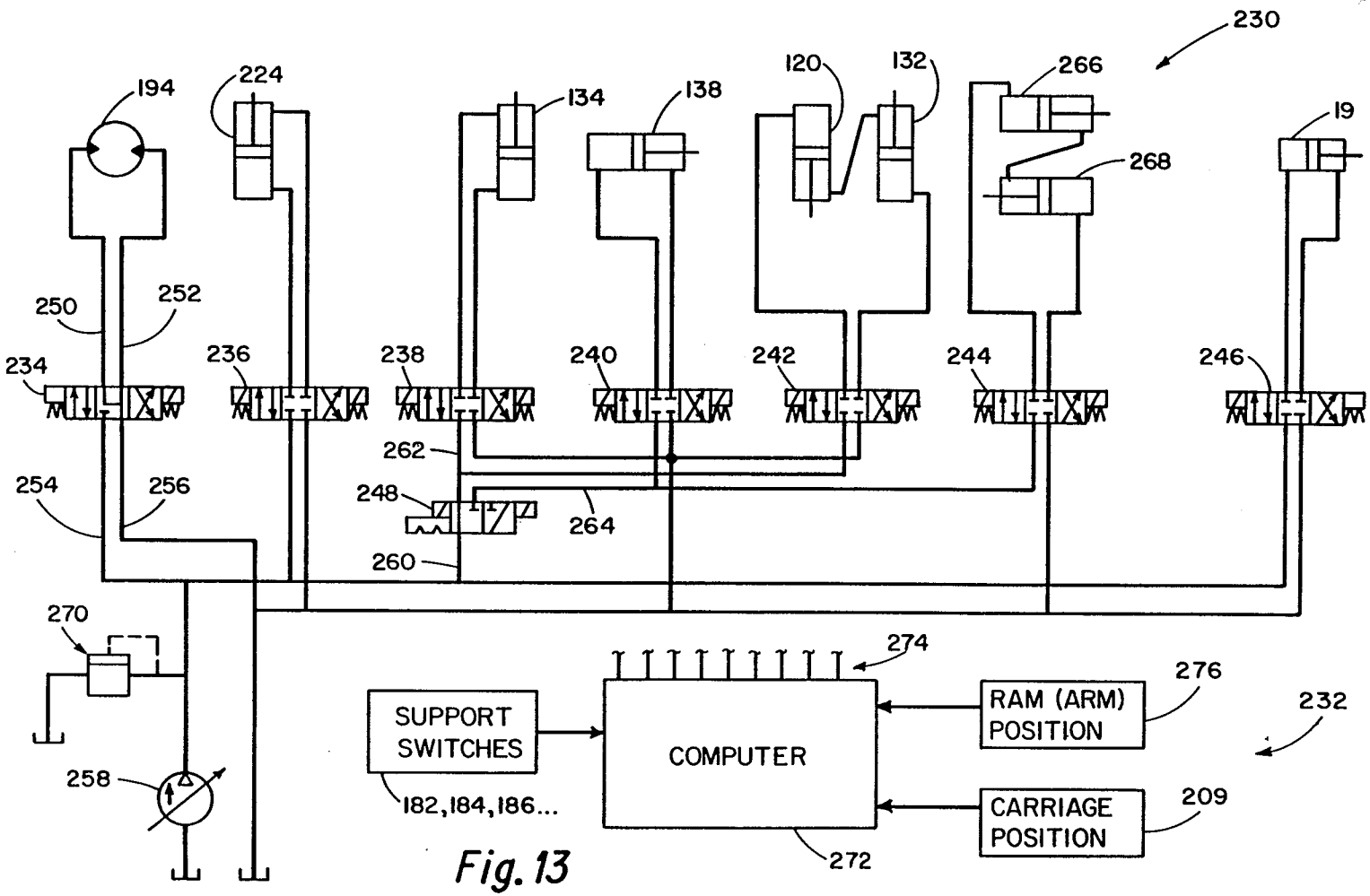
FIG. 13 is a schematic diagram of a portion of the electronic and fluidic controls for the automated pipe racking system.

Turning now to FIG. 13, indicated generally at 230 is a hydraulic circuit which is incorporated into the instant embodiment of the invention. Indicated generally at 232 is an electronic circuit, shown in schematic fashion, which is incorporated into the instant embodiment of the invention and which is interconnected with circuit 230 in a manner which will be hereinafter described. The structure which has been previously identified herein is identified with the same number in FIG. 13.

Included in circuit 230 are a plurality of electrically-controlled valves 234–248. Each of the valves is a conventional hydraulic valve and is actuated in response to an electrical signal applied thereto although for the sake of clarity the electric lines to each valve have been omitted from the drawing.

Valve 234 is connected to hydraulic lines 250, 252, 254, 256. Line 254 is connected to a hydraulic pump 258 which provides pressurized hydraulic fluid to line 254. When valve 234 is in the position shown in FIG. 13 hydraulic fluid does not pass through the valve and thus there is no flow in lines 250, 252. When the valve is moved to a first position, designated by parallel opposing arrows, fluid flows from line 254 to line 250, through motor 194 (which, as will be recalled, drives carriage 82) into line 252 and through the valve into line 256. When the valve is in its second position, designated schematically by the crossed arrows, fluid flows from line 254 to line 252, through motor 194 in the opposite direction, into line 250 and through the valve into line 256. It is thus seen that valve 234 provides a means for selectively driving hydraulic motor 194 (and thus carriage 82) either forward or backward.

In a similar fashion each of valves 236–246 are connected to various hydraulic rams as shown in the schematic and provide a means for either extending or retracting the ram to which the valve is connected.

Valve 248 is connected to lines 260, 262, 264. When valve 248 is in the position shown in FIG. 13, fluid under pressure from pump 258 flows into line 262 whereas no fluid flows in line 264. When valve 248 is in the other position thereof, designated by the diagonal line, fluid flows from line 260 into line 264 while no fluid flows in line 262.

Rams 266, 268 (not shown in the other drawings) are mounted on arm 74 and serve to extend and retract the arm in the same manner as rams 120, 132 extend and retract arm 76. As will be recalled, ram 134 (FIG. 2) operates pipe gripping head 80; ram 138 (FIG. 5) operates pipe gripping head 78; ram 224 (FIG. 2) rotates shaft 210 and therefore arm assembly 72 when the ram moves between its extended and retracted positions; ram 19 (FIG. 2) opens and closes elevators 16; and motor 194 (FIG. 12) moves carriage 82 along working board 84.

Finishing now the description of hydraulic circuit 230, a system relief valve 270 is provided to vent hydraulic fluid to the atmosphere in the event that excessive fluid pressure builds up in the hydraulic circuit.

Circuit 232 includes therein a conventional computer 272 which is programmed in a manner which will be hereinafter more fully described. The computer receives signals from tachometer 209 on carriage 82. The tachometer operates in a conventional manner and produces a constant number of pulses for each revolution of shaft 196 on the carriage with the polarity of the pulses being dependent upon the direction of shaft rotation. Such pulses are provided to the computer as shown in FIG. 13 thereby enabling the computer to monitor the position of the carriage relative to running board 84.

Each of rams 120, 132, 266, 268 includes therein a ram position sensor 276 (not shown in the other drawings). These rams control the position of arms 74, 76 and each is a conventional ram having sensors and circuitry (not shown) therein which generate an output signal containing information relating to the relative positions of the ram and the rod. For each of the arm rams the signal containing ram position information is provided to computer 272, such being illustrated schematically by ram (arm) position sensor 276 in FIG. 13. Thus, the computer is provided with signals indicating the extent to which each arm is extended from its retracted position. Since the computer is also provided with a signal which indicates the position of carriage 82, the computer can determine from available data the position of gripping heads 78, 80 relative to pipe rack 20 and to elevators 16.

A line from each of the switches (such being designated schematically in FIG. 13) in support assemblies 37, 39 in FIG. 7 is also provided to computer 272. Thus the computer is signaled each time the lower end of a pipe is set on or removed from a particular pipe support element, like pipe 188 on support element 168 in FIG. 9.

The computer further includes a plurality of output lines indicated generally at 274 which are connected in one-to-one relationship with valves 234–248 and with pump 258. Thus, each of the valves is operated by an output signal produced by computer 272 as is hydraulic pump 258. For the sake of clarity of FIG. 13 depection of the output lines connecting the computer with the various valves and the pump has been omitted.

Consideration will now be given to the operation of the disclosed embodiment of the automated pipe racking apparatus. Description will first be made of the operation when the apparatus is used to remove pipe from the well bore. First, elevators 16 are raised by the traveling block (not shown) until the upper female coupling, like coupling 36, of pipe 17 is raised above the level of working board 84. Slips are set between the drill string and the rig floor, as shown in FIG. 4, and the lower end of the exposed pipe stand is unthreaded in the usual manner. Next, the lower end of the pipe stand, as shown in FIG. 4, is set onto one of the pipe support elements, like pipe support element 164 in support assembly 39, thereby signaling the computer of the particular location on support assembly 39 upon which the lower end of the pipe stand is set. The lower end of the pipe is traditionally handled by rig hands working on drilling rig floor 41 but may also be manipulated by conventional arms which are manufactured for such use.

The computer is programmed to place valve 248 in the position shown in FIG. 13 and to actuate valve 242 to the position extending arm 76 responsive to the lower end of the pipe stand being set on the support assembly. Rams 120, 132 provide position information to the computer and when the arm is extended to the position of FIG. 4, i.e., to well center line 15, the computer returns valve 242 to the position of FIG. 13 thereby stopping further extension of arm 76. Next, the computer is further programmed to open valve 238 thereby providing fluid to ram 134 and closing gripping head 80. Simultaneously with the opening of valve 238, valve 246 is actuated to open elevators 16. Thereafter valve 242 is actuated to the position for retracting arm 76. When the arm is fully retracted, the computer generates an output signal which is applied to valve 236 (thereby extending ram 134) for rotating the arm 90° into alley 104 as shown in FIG. 2. The above-described computer controls may be easily programmed by a person having ordinary skill in the art and amount to generating a preselected set of output signals on lines 274 responsive to switching of a switch on support assembly 39.

After arm 76 is rotated 90°, the computer actuates valve 234 thereby providing fluid to motor 194 and driving carriage 82 from the dashed line position (in FIG. 2) toward the dot-dash position. The computer memory includes stored therein a data table that includes each of the switch locations in support assemblies 37, 39 and has associated therewith a carriage position. Thus, for each switch actuated by the lower end of a pipe stand being set thereon, the carriage drives to a preselected position. For the switch upon which pipe stand 17 is placed, the carriage drives until the upper end of the pipe stand is opposite slot 66.

The computer memory further includes a second data table in which each switch is associated with an extended position of arm 76. When the carriage is opposite the slot mandated by the first data table in the computer, arm 76 extends the appropriate distance mandated by the second data table. When the arm is so positioned, valve 238 moves to a position in which gripping head 80 opens and thereafter the arm returns to its fully retracted position, the carriage returns to its dashed line position in FIG. 2, and arm 76 rotates 90° back to the solid-line position of arm 76 in FIG. 2.

While the apparatus is storing the upper end of the pipe stand in slot 66 as described, the rig traveling block lowers elevators 16 to the floor where they are closed manually about the next pipe stand, which is suspended by slips from the drilling rig floor in the well bore as shown in FIG. 4. Thereafter the elevators are raised and when arm 76 returns to the position of FIG. 2, the next stand of pipe to be racked is in the position of pipe 17. Slips are again used to suspend the drill string, the next pipe stand is unthreaded and the lower end of the pipe stand is set down adjacent the previous pipe stand on the support assembly. Actuation of the switch on the support assembly causes the carriage to move the upper end of the next pipe stand to slot 66 and the arm to extend until the upper end of the stand is adjacent the previously racked pipe stand. Since a preselected number of pipe stands fill slot 66, with the lower end of each pipe stand filling a row of pipe support locations on support assembly 39, the program causes the carriage to drive to the next empty slot when the previous slot is full.

In a similar fashion, as each slot is filled with pipe stands in order, when all of the slots in finger set 50 are full, the program causes arm 74 to be used in a substantially identical symmetrical fashion to fill the slots defined by finger set 48 on the opposite side of the working board. Thus, a pipe is gripped by head 78, arm 74 is retracted and ram 224 is retracted thereby moving the pipe in head 78 into alley 102 in position for racking the pipe in slot 68. Pipes are positioned one at a time in slot 68 until it is full and thereafter each of the other slots is filled in order. While slots defined by finger set 48 are being filled, the computer program causes valve 248 to move to the other position thereof and actuates valves 240, 244 (as well as valves 234, 236, 246) in a manner similar to when slots defined by finger set 50 are being filled.

It is to be appreciated that all of the computer programming described above may be performed by a person having ordinary skill in the art. The programming amounts to storing selected carriage and arm positions in a pair of memory tables as described, with each such position being associated with the actuation of a particular switch in support assemblies 37, 39. For a given input, arm and carriage position and a support assembly switch actuation, particular output signals are generated on output lines 274.

After all of the pipe in the well bore is removed and racked, the drill bit may be changed or a selected tool may be readied for running into the well bore, whichever is the case. The tool or bit is mounted on the first pipe or drill collar which is suspended by slips in the well bore. When unracking pipe, the computer must be signaled by an operator to generate signals which drive the carriage and the appropriate arm to the position of the last-stored pipe stand in the rack. When the computer is so signaled the appropriate output signals are generated on line 274 thereby driving the arm, carriage and gripping head, as previously described, to grip the last-stored pipe stand. When so gripped, the arm is retracted until the pipe stand is received in the alley, the carriage is driven back to the dashed line position of FIG. 2 and the arm is rotated 90° and extended to present the pipe stand elevators 16, which are open. The computer operates valve 246 thereby closing the elevators via ram 19 while simultaneously opening the gripping head. When the traveling block picks up on the elevators thereby removing the lower end of the pipe stand from the support assembly and permitting it to swing into alignment with the well center, the switch on which the lower end of the stand was resting is deactuated. Next, the pipe stand held by the elevators is threadably engaged with the upper pipe in the slips which are then removed. Thereafter the traveling block is lowered until the newly-added pipe stand is received in the well bore and slips are inserted to suspend the same therein. The elevators are manually opened and returned to the position of FIG. 2 to receive the next stand of pipe.

The computer has a third and fourth data table stored in the memory thereof which are used only in the unracking process. The third data table associates a selected switch with a selected carriage position, namely the carriage position for accessing the next stand of pipe when the preceeding pipe is removed from its support assembly switch. In a similar fashion, the fourth table associates each support assembly switch with a selected arm position which is necessary for reaching the next pipe stand after the preceeding pipe stand has been lifted from its associated support assembly switch. Thus, when the preceeding pipe stand is lifted by the rig tackle and elevators 16 from the support assembly, the computer is programmed to drive carriage 82 to the appropriate slot for retrieving the upper end of the next pipe stand and the arm extends a sufficient amount to grasp the stand with its associated gripping head. As soon as the arm is so extended and the pipe gripped, the computer program generates signals which retract the arm and return the carriage to the dashed line position in FIG. 2. The arm is rotated 90° and extended thereby presenting the upper end of the stand to elevators 16 which lifts the same from the support assembly thereby signaling a repeat of the process for retrieving the next pipe stand. The pipes are removed in exactly reverse order as they were racked with the computer operating arm 74 for unracking finger set 48 and arm 76 for unracking finger set 50.

It is to be appreciated that additions and modifications may be made to the embodiment of the invention disclosed herein without departing from the spirit of the invention which is defined by the following claims.

What is claimed is:

1. An apparatus for use to facilitate coupling and uncoupling substantially vertical lengths of pipe by moving the pipe between the coupled position thereof and a racking assembly, said apparatus comprising:

an arm assembly having a gripping head mounted thereon for grasping a pipe;

means for moving said arm assembly;

a support assembly for supporting the lower end of a pipe received in said racking assembly;

means for sensing the location of the lower end of each pipe on said support assembly; and control means operatively connected to said sensing means and to said moving means for moving said arm assembly to a preselected position dependent upon the position of the lower end of a pipe which is set on or removed from said support assembly.

2. The apparatus of claim 1 wherein said moving means comprises a carriage slidingly mounted on a track adjacent said racking assembly.

3. The apparatus of claim 2 wherein said control means includes means for driving said carriage to a preselected position on said track dependent upon the position of the lower end of a pipe which is set on or removed from said support assembly.

4. The apparatus of claim 3 wherein said apparatus further includes means for extending and retracting said arm assembly relative to said carriage.

5. The apparatus of claim 4 wherein said racking assembly includes a plurality of fingers extending transversely from one side of said track and wherein said control means includes means for driving said arm assembly to a preselected position relative to said carriage dependent upon the position of the lower end of a pipe which is set on or removed from said support assembly.

6. The apparatus of claim 5 wherein said racking assembly further includes a plurality of fingers extending transversely from the other side of said track and wherein said apparatus further includes rotating means disposed between said arm assembly and said carriage assembly for enabling orientation of said arm assembly toward said fingers on either side of said track.

7. The apparatus of claim 6 wherein said arm assembly further includes a first arm and a second arm, said arms being extendable and retractable along axes oriented at 90° to one another.

8. The apparatus of claim 5 wherein said apparatus is for use to facilitate coupling substantially vertical lengths of pipe and for moving the pipe from said racking assembly to the position at which said pipe lengths are coupled and wherein said control means comprises a computer programmed to drive said carriage and said arm assembly to a position in which a pipe length in said racking assembly is received in said gripping head responsive to a pipe length being removed from said support assembly.

9. The apparatus of claim 8 wherein said computer is further programmed to grip the pipe length received in said gripping head and thereafter drive said carriage and said arm assembly to a position in which the upper end of said pipe is substantially in position for coupling.

10. The apparatus of claim 5 wherein said apparatus is used to facilitate uncoupling substantially vertical lengths of pipe and for moving the pipe from the position at which said pipe lengths are uncoupled to said racking assembly and wherein said control means comprises a computer programmed to drive said carriage and said arm assembly to a position in which a pipe length in position for uncoupling is received in said gripping head responsive to a pipe length being set on said support assembly.

11. The apparatus of claim 10 wherein said computer is further programmed to grip the pipe received in said gripping head and thereafter drive said carriage and said arm assembly to a position in which the upper end of said pipe is received in said racking assembly.

12. The apparatus of claim 1 wherein said sensing means comprises a plurality of switches mounted on said support assembly, each of said switches being actuated responsive to the lower end of a pipe being set thereon or removed therefrom.

13. Apparatus for moving substantially vertical lengths of pipe between the center line of a well and a pipe storage position, said apparatus comprising:

a first set of racking fingers located adjacent the upper end of such pipe lengths, said racking fingers being substantially parallel to one another and spread apart by an amount greater than the diameter of such pipe and further being substantially normal to the well center line;

a second set of racking fingers located adjacent the upper end of such pipe lengths, said racking fingers being substantially parallel to one another and spaced apart by an amount greater than the diameter of such pipe and further being substantially opposed from and substantially parallel to the fingers in said first set of racking fingers;

an elongate track suspended between said racking fingers;

a carriage mounted on said tracks for movement toward and away from the well center line;

an arm support member mounted on said carriage and being rotatable about an axis substantially parallel to the well center line;

a first gripping arm fixedly mounted on said arm support member and being moveable along a first arm axis substantially normal to the axis of rotation of said arm support member;

a second gripping arm fixedly mounted on said arm support member and being movable along a second arm axis substantially normal to the axis of rotation of said arm support member and to said first arm axis; and means for rotating said arm support member between a first position in which said first arm axis substantially intersects the well center line and a second position in which said second arm axis substantially intersects the well center line.

14. The aparatus of claim 13 wherein said apparatus further includes a support assembly for supporting the lower end of a length of pipe when the upper end thereof is received between adjacent racking fingers.

15. The apparatus of claim 14 wherein said apparatus further includes:

means for sensing the location of the lower end of each pipe length on said support assembly; and control means operatively connected to said sensing means for driving said carriage to a preselected position on said track dependent upon the position of the lower end of a pipe which is set on or removed from said support assembly.

16. The apparatus of claim 15 wherein said sensing means comprises a plurality of switches mounted on said support assembly and wherein the lower end of each pipe length in the pipe storage position actuates a selected switch and the upper end thereof is received between a pair of racking fingers at a selected position which is associated with said selected switch.

17. The apparatus of claim 16 wherein said control means includes means for driving said carriage to a preselected pair of fingers having a stored pipe received therebetween responsive to a pipe being removed from said support assembly.

18. The apparatus of claim 16 wherein said control means includes means for rotating said arm support member to position one of said gripping arms for gripping said stored pipe responsive to a pipe being removed from said support assembly.

19. The apparatus of claim 16 wherein said control means further includes means for moving said one arm along the arm axis thereof to said selected position for gripping said stored pipe with said one arm responsive to a pipe being removed from said support assembly.

20. The apparatus of claim 16 wherein said control means includes means for driving said carriage to a pair of racking fingers responsive to a pipe being set on a switch on said support assembly, said pair of racking fingers including the selected position associated with said switch.

21. The apparatus of claim 20 wherein said control means includes means for moving one of said gripping arms along the axis thereof to said selected position responsive to said pipe being set on said switch associated with said selected position.

22. Apparatus for moving substantially vertical pipes between a well center line and a rack comprising a plurality of discrete pipe storage positions for receiving the upper ends of such pipe, said apparatus comprising:

an arm for gripping such pipe adjacent the upper end thereof;

means for moving said arm;

a support assembly beneath said rack comprising a plurality of discrete pipe support positions for supporting the lower end of such pipes when the upper end thereof is received in one of said pipe storage positions, each of said pipe support positions being associated with a different pipe storage location whereby a pipe received in a selected pipe storage location is always supported by the associated pipe support position;

means for indicating when a pipe is set on or removed from a pipe support position; and control means operatively connected to said arm and to said indicating means for driving said arm between the well center line and a pipe storage position responsive to a pipe being set on or removed from a pipe support position.

23. The apparatus of claim 22 wherein said control means includes means for causing said arm to grip the upper end of a pipe at the well center line responsive to the lower end of said pipe being set on a pipe support position.

24. The apparatus of claim 23 wherein said control means includes means for driving said arm to the pipe storage position associated with said pipe support position after said pipe is so gripped.

25. The apparatus of claim 22 wherein said apparatus moves pipe from said rack to the well center line in a predetermined sequence and wherein said control means includes means for causing said arm to grip the upper end of a pipe in a pipe storage position responsive to the preceeding pipe being removed from its pipe support position.

26. The apparatus of claim 25 wherein said control means includes means for driving said arm to the well center line after said pipe is so gripped.

* * * * *